US008402898B2

(12) United States Patent
Rodnunsky

(10) Patent No.: US 8,402,898 B2
(45) Date of Patent: Mar. 26, 2013

(54) SAFETY SYSTEM AND METHOD FOR OBJECTS MOVED BY A DRIVING CABLING SYSTEM

(75) Inventor: Jim (James) Rodnunsky, Los Angeles, CA (US)

(73) Assignee: Cablecam, LLC, Fort Worth, TX (US)

( * ) Notice: Subject to any disclaimer, the term of this patent is extended or adjusted under 35 U.S.C. 154(b) by 715 days.

(21) Appl. No.: 12/480,537

(22) Filed: Jun. 8, 2009

(65) Prior Publication Data

US 2009/0301814 A1 Dec. 10, 2009

Related U.S. Application Data

(60) Provisional application No. 61/059,786, filed on Jun. 8, 2008.

(51) Int. Cl.
*B66C 21/00* (2006.01)

(52) U.S. Cl. ..... 104/173.1; 212/76; 212/100

(58) Field of Classification Search ..... 104/173.1, 104/174, 175, 178, 180; 212/76, 80, 97, 212/98, 100, 102, 105
See application file for complete search history.

(56) References Cited

U.S. PATENT DOCUMENTS

| | | | |
|---|---|---|---|
| 367,610 | A | 8/1887 | Fairman |
| 482,648 | A | 9/1892 | Olson |
| 494,389 | A | 3/1893 | Shorman |
| 578,980 | A | 3/1897 | Eddy |
| 700,321 | A | 5/1902 | French |
| 894,348 | A | 7/1908 | Seele |
| 942,038 | A | 11/1909 | Miller |
| 969,356 | A | 9/1910 | Fitzgerald |
| 1,002,897 | A | 9/1911 | Brown |
| 1,086,912 | A | 2/1914 | Hadsel |
| 1,247,309 | A | 11/1917 | Miller |
| 1,301,967 | A | 4/1919 | Parks |
| 1,634,950 | A | 7/1927 | Lucian |
| 1,729,964 | A | 10/1929 | Peugh |
| 1,729,984 | A | 10/1929 | Canfield |
| 1,782,043 | A | 11/1930 | Lawson |
| 1,948,934 | A | 2/1934 | O'Rourke |
| 1,955,770 | A | 4/1934 | Richards |
| 2,004,133 | A | 6/1935 | Romano |
| 2,035,107 | A | 3/1936 | Voss |
| 2,055,673 | A | 9/1936 | Smilie |
| 2,446,096 | A | 7/1948 | Moore |
| 2,490,628 | A | 12/1949 | Isserstedt |
| 2,523,287 | A | 9/1950 | Friedman |
| 2,899,882 | A | 8/1959 | Wylie |

(Continued)

FOREIGN PATENT DOCUMENTS

| | | |
|---|---|---|
| AT | 150740 | 9/1937 |
| FR | 992069 | 10/1951 |

(Continued)

OTHER PUBLICATIONS

Publication No. 2009/0207250, published Aug. 20, 2009 by Bennett et al.

*Primary Examiner* — S. Joseph Morano
*Assistant Examiner* — Zachary Kuhfuss
(74) *Attorney, Agent, or Firm* — Factor Intellectual Property Law Group, Ltd.

(57) ABSTRACT

A safety system and method for objects moved by a driving cabling system. Offers a redundant back-up system that activates when the main cable system fails. The safety system has various embodiments and may be utilized with camera movement systems configured to move the camera throughout two or three-dimensional space.

19 Claims, 4 Drawing Sheets

U.S. PATENT DOCUMENTS

| | | | |
|---|---|---|---|
| 3,043,444 | A | 7/1962 | Melton |
| 3,065,861 | A | 11/1962 | Cruciani |
| 3,094,054 | A | 6/1963 | Moors et al. |
| 3,107,791 | A | 10/1963 | Michael |
| 3,333,713 | A | 8/1967 | Cruciani |
| 3,638,502 | A | 2/1972 | Leavitt et al. |
| 3,675,794 | A | 7/1972 | Ingram et al. |
| RE27,621 | E | 4/1973 | McIntyre |
| 3,973,680 | A | 8/1976 | Van der Lely et al. |
| 4,017,168 | A | 4/1977 | Brown |
| 4,136,786 | A | 1/1979 | Morrow |
| 4,227,479 | A | 10/1980 | Gertler et al. |
| 4,331,975 | A | 5/1982 | Krawza |
| 4,372,535 | A | 2/1983 | Gibson et al. |
| 4,625,243 | A | 11/1986 | Takubo |
| 4,625,938 | A | 12/1986 | Brown |
| 4,710,819 | A | 12/1987 | Brown |
| 4,715,598 | A | 12/1987 | Knight |
| 4,864,937 | A | 9/1989 | Kunczynski |
| 5,107,771 | A | 4/1992 | Kainz |
| 5,113,768 | A | 5/1992 | Brown |
| 5,224,426 | A | 7/1993 | Rodnunsky et al. |
| 5,333,257 | A | 7/1994 | Merrill et al. |
| 5,341,121 | A | 8/1994 | Rada |
| 5,440,476 | A | 8/1995 | Lefkowitz et al. |
| 5,531,453 | A | 7/1996 | Penston, III |
| 5,568,189 | A | 10/1996 | Kneller |
| 5,585,707 | A | 12/1996 | Thompson et al. |
| 5,600,368 | A | 2/1997 | Matthews, III |
| 6,023,862 | A | 2/2000 | Sirjola |
| 6,145,679 | A | 11/2000 | Walters |
| 6,199,829 | B1 | 3/2001 | Brown et al. |
| 6,566,834 | B1 | 5/2003 | Albus et al. |
| 6,648,102 | B2 | 11/2003 | Bostelman et al. |
| 6,809,495 | B2 | 10/2004 | Rodnunsky |
| 6,873,355 | B1 | 3/2005 | Thompson et al. |
| 6,975,089 | B2 | 12/2005 | Rodnunsky et al. |
| 7,036,436 | B2 | 5/2006 | MacDonald et al. |
| 7,088,071 | B2 | 8/2006 | Rodnunsky |
| 7,127,998 | B2 | 10/2006 | MacDonald et al. |
| 7,207,277 | B2 | 4/2007 | Rodnunsky |
| 7,239,106 | B2 | 7/2007 | Rodnunsky et al. |
| 2005/0024005 | A1* | 2/2005 | Rodnunsky et al. ..... 318/649 |

FOREIGN PATENT DOCUMENTS

| | | |
|---|---|---|
| FR | 2318664 | 2/1977 |
| GB | 516185 | 12/1939 |

* cited by examiner

SAFETY SYSTEM AND METHOD FOR OBJECTS MOVED BY A DRIVING CABLING SYSTEM

This patent application claims benefit of U.S. Provisional Patent Application Ser. No. 61/059,786, filed 8 Jun. 2008, the specification of which is hereby incorporated herein by reference.

BACKGROUND OF THE INVENTION

1. Field of the Invention

One or more embodiments of the invention relate to the field of camera rigging systems and more particularly, but not by way of limitation, are directed to providing a safety backup mechanism for an aerial cable system that is configured to move objects such a camera throughout space in two or three-dimensions.

2. Description of the Related Art

Existing cable systems move objects such as cameras above the ground in two or three dimensions. Some of these systems such as U.S. Pat. No. 6,809,495 provide built in redundancy, so if one line side breaks, another line side keeps the object from hitting the ground. Other systems such as U.S. Pat. No. 7,207,277 disclose embodiments that may use one line, hence if one side of that line breaks, the object may hit the ground. Systems such as U.S. Pat. No. 4,710,819 use at least three lines, and if any of these lines break, the object may hit the ground.

Although some systems may inherently limit the suspended object from hitting the ground with built in redundancy of lines, there is a need for a safety system and method for objects moved by a driving cabling system to ensure that the suspended object does not hit the ground.

BRIEF SUMMARY OF THE INVENTION

One or more embodiments of the invention are directed to providing a safety system for an aerial cable system. Aerial cable systems are commonly employed for purposes of moving a camera into spaces that might be otherwise out of reach. There are various types of cabling systems some of which move the camera in three-dimensions and others which move the camera in two-dimensions. These camera movement systems are employed at sporting events that give sports fans dramatic "on the field" views of the action underneath. Operators are able to fly the camera behind the players and follow the action to the end of a play. In addition, aerial cable systems are also used in the filming of motion pictures and give camera viewpoints that are otherwise not attainable or more costly to achieve.

One issue that exists with these cabling systems is the risk of a cable breaking while under the load of a suspended camera. The risk, while negligible if proper cabling strengths are used, presents a hazard for people and property in proximity to the cabling system. Breaking of the cable represents a potential hazard of these aerial cable systems as the camera and the supporting cables employed in these systems are heavy and can travel in some instances at a high rate of speed. A breaking cable raises the risk of personal injury to persons underneath the system. While these aerial cable systems offer safety features to avoid injury to persons in the event of a cable break, one or more embodiments of the invention described herein offers a redundant back-up system that activates when the main cable system fails. The safety system has various embodiments and may be utilized with camera movement systems configured to move the camera throughout two or three-dimensional space.

BRIEF DESCRIPTION OF THE DRAWINGS

The above and other aspects, features and advantages of the invention will be more apparent from the following more particular description thereof, presented in conjunction with the following drawings wherein:

FIG. 1 shows an example A-B system that embodiments of the invention may be utilized with.

DETAILED DESCRIPTION OF THE INVENTION

Figure 1:
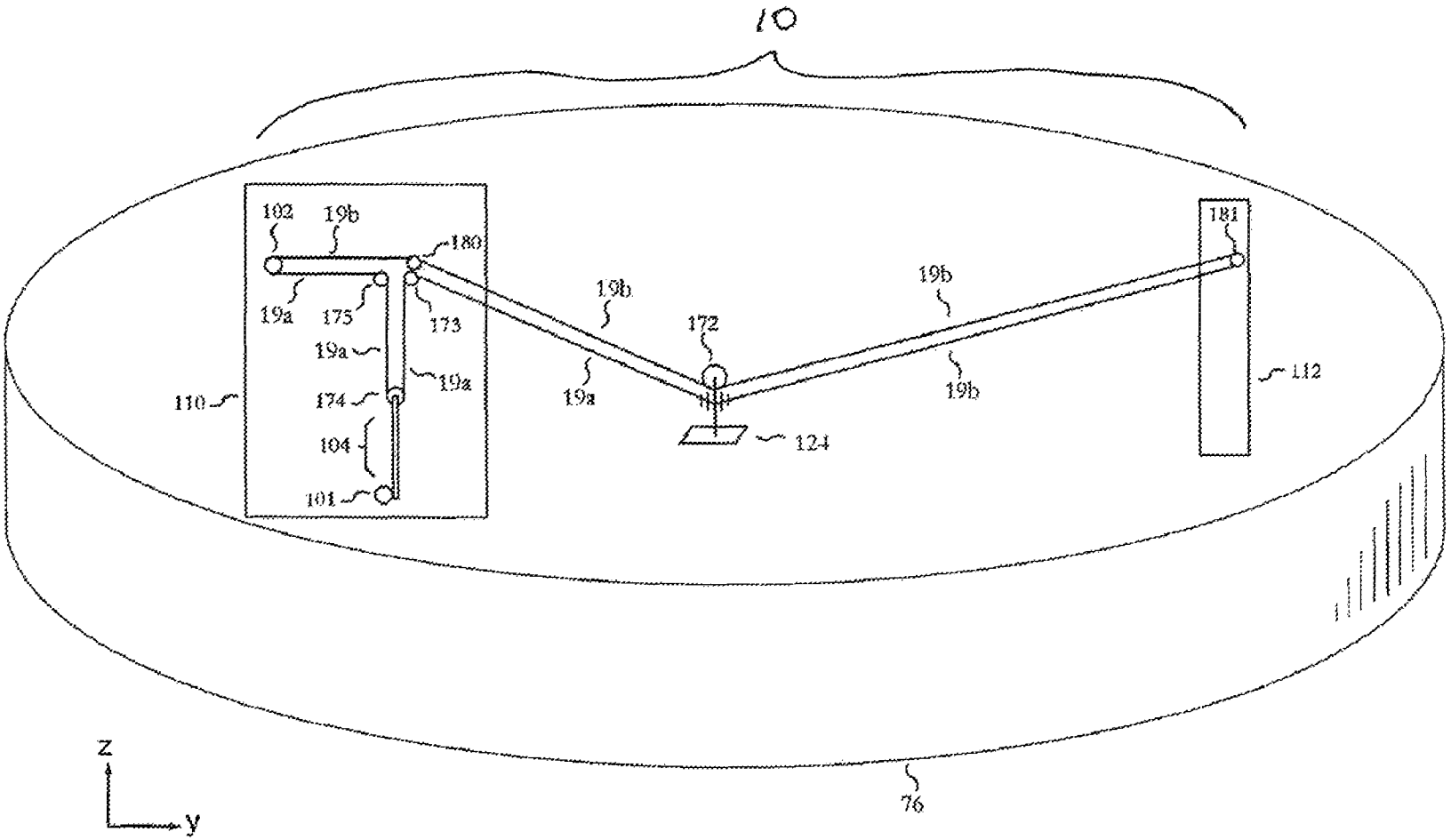

One or more embodiments of the invention are directed to providing a safety system for an aerial cable system. In the following description numerous specific details are set forth in order to provide a more thorough understanding of embodiments of the invention. It will be apparent, however, to an artisan of ordinary skill that the present invention may be practiced without incorporating all aspects of the specific details described herein. Any mathematical references made herein are approximations that can in some instances be varied to any degree that enables the invention to accomplish the function for which it is designed. In other instances, specific features, quantities, or measurements well-known to those of ordinary skill in the art have not been described in detail so as not to obscure the invention. Readers should note that although examples of the invention are set forth herein, the claims, and the full scope of any equivalents, are what define the metes and bounds of the invention.

Aerial cable systems are commonly employed for purposes of moving a camera into spaces that might be otherwise out of reach. There are various types of cabling systems some of which move the camera in three-dimensions and others which move the camera in two-dimensions. These camera movement systems are employed at sporting events that give sports fans dramatic "on the field" views of the action underneath. Operators are able to fly the camera behind the players and follow the action to the end of a play. In addition, aerial cable systems are also used in the filming of motion pictures and give camera viewpoints that are otherwise not attainable or more costly to achieve.

One issue that exists with these cabling systems is the risk of a cable breaking while under the load of a suspended camera. The risk, while negligible if proper cabling strengths are used, presents a hazard for people and property in proximity to the cabling system. Breaking of the cable represents a potential hazard of these aerial cable systems as the camera and the supporting cables employed in these systems are heavy and can travel in some instances at a high rate of speed. A breaking cable raises the risk of personal injury to persons underneath the system. While these aerial cable systems offer safety features to avoid injury to persons in the event of a cable break, one or more embodiments of the invention described herein offers a redundant back-up system that activates when the main cable system fails. The safety system has various embodiments and may be utilized with camera movement systems configured to move the camera throughout two or three-dimensional space. The system functions with three-dimensional systems such as the embodiments described in U.S. patent application Ser. No. 11/772,752 filed 2 Jul. 2007, the specification of which is incorporated herein by reference. Other embodiments of the invention are adapted for use with two-dimensional or A to B systems configured to move a camera platform from point A to point B. The safety system depicted in FIGS. 2, 3, and 4 may overlay existing aerial cable systems and operate in large part, independent of but in complement with, aerial cable systems. The system is configured to maintain tension on the safety line so as to prevent the safety line from interfering with activities on the ground or movement of the camera. In one or more instances the line for the safety system runs redundant to the aerial cable system.

FIG. 1 shows an example A-B system 10 that embodiments of the invention may be utilized with. Motion along the "A-B" axis is denoted as Y axis movement in the figure. Vertical movement is shown as displacement along the Z axis. As shown in FIG. 1, platform 124 provides an attachment point for objects to be moved, including but not limited to cameras for example. In this configuration, support structures 110 and 112 separate platform 124 from the ground in stadium 76. Platform 124 is supported and is moved in two dimensions by one line. The line forms a "V" shape when viewed from the perspective of FIG. 1. By decreasing the length of the line deployed into the system via Z-axis motor 101 and Z movement device 104, platform 124 is raised. Conversely, increasing the length of the line deployed, platform 124 is lowered. YZ movement line sides 19*a* and 19*b* are different sides of the same piece of line. Control of Y and Z-axis motors can be in the form of simple switches, potentiometers, or an optional but not required computer control system. Z movement device 104 is coupled with YZ movement line side 19*a*. Sheave 172 rides on YZ movement line side 19*b*. By rotating Y-axis motor 102 (attached to a bull wheel that drives the line but is not shown for ease of viewing), thereby decreasing the amount of line on YZ movement line side 19*a*, which increases the amount of line on Y movement side 19*b*, the platform moves mainly in the negative Y direction, or to the left as shown in the figure.

Figure 2:
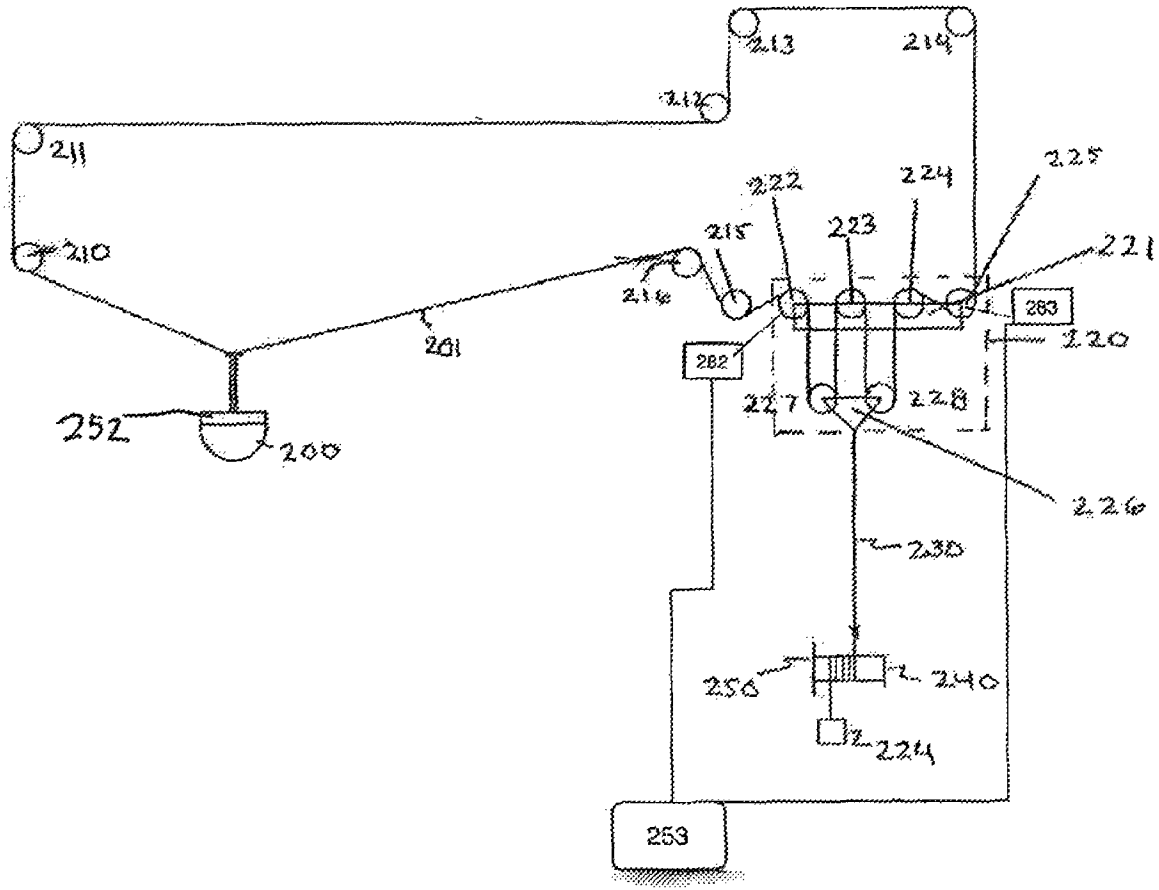
FIG. 2 shows a reeving diagram of a two-dimensional embodiment of the invention.

FIG. 2 presents an embodiment of the safety system utilized in conjunction with a two-dimensional A to B system that moves a camera platform from a point A to point B. Examples of such systems are described in U.S. patent application Ser. Nos. 11/411,972, filed 25 Apr. 2006, the specifications of which are incorporated herein by reference.

Referring still to FIG. 2, Camera platform 200 is coupled to the line 201, either by a fixed means or by a means by which the camera platform 200 can move relative to line 201. Line 201 forms a closed loop that reeves through multiple sheaves as represented by sheaves 210, 211, 212, 213, and 214, through block and tackle 220, and through sheaves 215 and 216 where it then runs back to the camera platform 200. Sheaves 210, 211, 212, 213, and 214 serve to redirect the line 201 and can be adapted for installation of the system in various venues, such as stadium 76 in FIG. 1 for example. Hence the manner of redirection is not limited to what is depicted here but may be adapted as needed for installation in venues such as stadiums or other such locations as needed. In one or more embodiments of the invention line 201 may form an open loop. Sheaves 210 and 216 act to redirect line 201 to camera platform 200.

Block and tackle 220 further comprises top block 221 and bottom block 226. During routine operation, line 201 acts as a redundant passive safety line that follows camera platform 200 as it is moved by the aerial cable system, for example as shown in FIG. 1 or any other two-dimensional "A-B" system. The bulk of the weight of the camera platform 200 is held by the aerial cable rail system of FIG. 1 for example (line sides 19*a* and 19*b*). As the camera platform traverses space, block and tackle 220 expands and contracts accordingly so that there is sufficient tension in line 201 such that line 102 remains taut.

Top block 221 holds sheaves 222, 223, 224, and 225. Bottom block 226 holds sheaves 227 and 228. Line 201 reeves through the sheaves on top block 221 to the sheaves on bottom block 226 and back to sheaves on the top block 221 so that the sheaves on top block 221 and the sheaves on bottom block 226 are reeved with line 201.

Line 230 is attached to bottom block 222 and runs to and coils around capstan winch 240, and then runs to floating counter weight 224 to which line 230 is affixed. Capstan winch has a disk break 250 that deploys in the event of failure to stop capstan winch 240 from rotating, hence preventing deployment of line 230. Line 201 and/or line 230 may be set to the desired length for the particular venue installation so as to provide the desired amount of line in the system for the range of motion of any associated cabling system that the desired embodiment of the invention is coupled with.

The configuration having block and tackle 220 coupled to a floating counterweight 224 through a capstan winch 240 offers several benefits. This configuration draws tension on line 201 while dynamically storing excess line 201 as camera platform 200 is moved by the aerial cable system. For example, should the aerial cable system move camera platform 200 from an outer region to a region midway between sheaves 210 and 216, the amount of line 201 necessary to reeve between sheaves 210 and 216 will decrease. As the camera platform 200 begins to move to the midway point between sheaves 210 and 216, line 210 will therefore be under reduced tension. As the tension in the line decreases, block and tackle 120 will begin to expand as the downward force of the weight of floating counter weight 224 will be greater than the reduced upward force due to the decreased tension in line 201. As block and tackle 120 expands, the amount of line 201 contained within block and tackle 120 increases, which effectively stores the excess line 201. Likewise, should the aerial cable system move camera platform 200 to an outer region, the tension on line 201 will increase which will, in turn, cause block and tackle 220 to release some of the portion on line 201 stored in block and tackle 220.

An additional benefit is that the use of a block and tackle 220 reduces the amount of expansion and contraction by multiplication factor equal to the number of lines of line 201 that traverse between the sheaves on the upper block 221 and bottom block 226. For example, where 4 lines of line 201 traverse the sheaves of the upper block 221 and lower block 226, a fourfold multiplication factor will result. That means that block and tackle 220 will expand only one fourth of length of the line 201 no longer need to reeve through sheaves 210 and 216.

Having a multiplication factor reduces the amount of weight of the floating counterweight 224 by one fourth. This also reduces the amount of breaking force required by the disk break 250 by a factor of one fourth.

Another advantage is that the multiplication factor also results in a fourfold advantage in terms of the speed of the retraction of line 201 compared to the speed of the forced expansion of the block and tackle 220. In one embodiment of the invention, a mechanism for forcing the expansion or contraction of the block and tackle 220 is contemplated. For example, if the block and tackle 220 is coupled with a means for forcing the expansion, line 201 will retract at a speed equal to the product of the multiplication factor of the block and tackle 220 and the speed of the expansion of the block and tackle 220. For example, if there are 10 sheaves within the block and tackle 220, the speed of the refraction of the Line will be 10 times greater than the speed of the expansion of the block and tackle 220. This assembly provides acceleration of retraction of line 201 that far exceeds the movement possible if the line 201 were coupled to a winch or directly to some other movement device.

One embodiment of the invention makes use of a braking system to further limit movement of the line in the event of a line break in the aerial cable system it is supporting. As the camera platform traverses space, sensors 252 on the camera platform 200 monitor the characteristics of the camera platform 200. In some instances sensors 282, 283 can be placed separate and apart from camera platform 200. Examples of the type of characteristics that the sensors will monitor include, but are not limited to, the location, velocity, speed, acceleration, orientation, and rotation of the camera platform 200. A controller 253 monitors these sensors and compares the actual measured characteristics to the expected characteristics of the camera platform 200. In the event of a breakage of a cable in an aerial cable system, the measured characteristics will differ from the expected characteristics as the camera platform 200 starts to fall. When the measured characteristics exceed a range of permissible expected characteristics, the controller will issue a warning signal indicating that a cable has broken. One form of this warning signal is an electric signal that activates the disk break 250 which locks capstan disk 240 from further rotating. Disk break 250 is also triggered preventing capstan disk 240 from further rotation. Having these brakes triggered in turn, prevents the block and tackle 220 from further expanding which, in turn, prevents a greater portion of line 201 to be drawn between the sheaves, and effectively captures the camera platform 200 to prevents the camera platform 200 from falling further.

Figure 3:
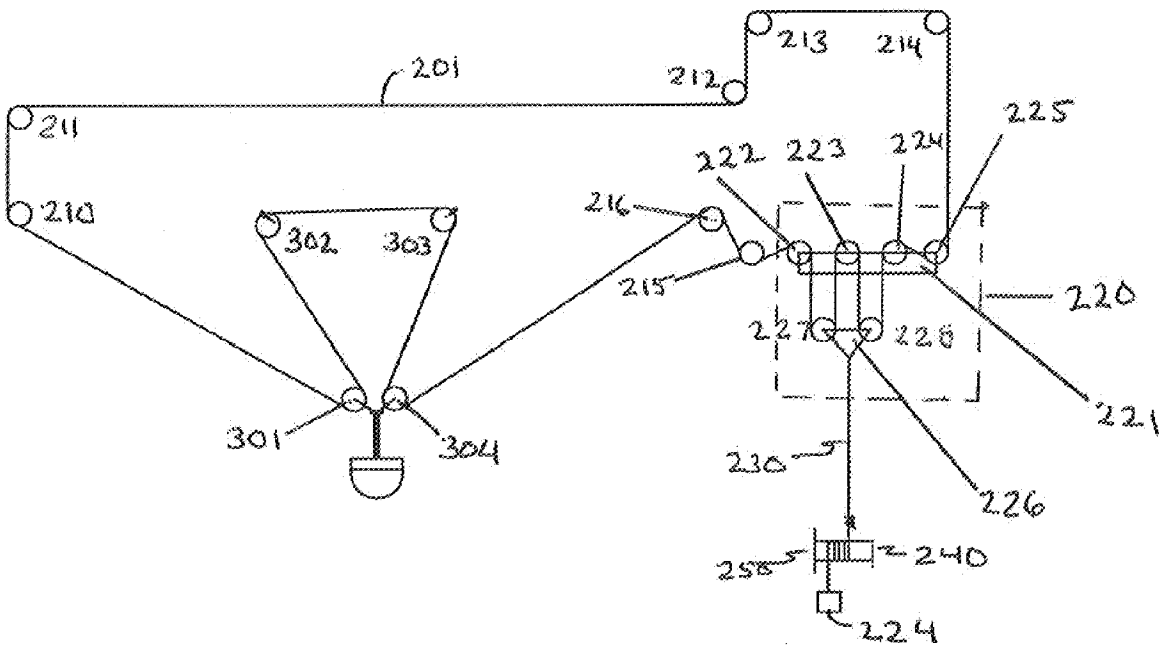
FIG. 3 shows an alternate reeving diagram of a two-dimensional embodiment of the invention.

FIG. 3 presents another embodiment of the invention in which a four point safety system is disclosed. In the FIG. 3 embodiment, line 201 also reeves through sheaves 301, 302, 303, and 304, where sheaves 301 and 304 are coupled to camera platform 200. Having a configuration where the camera has mounted sheaves results in the camera platform being not securely fixed to line 201. Sheaves 302 and 303 in combination with sheaves 301, 304, 216 and 210 are used to suspend line to the camera without suspending the camera platform, which is performed for example by line sides 19*a* and 19*b* of FIG. 1 for example. Sheaves 302 and 303 can be suspended from the same points that sheaves 210 and 216 are suspended for example.

One benefit of this embodiment is that, if the camera platform falls near the perimeter of the three-dimensional space, camera platform 200 will roll to the center of the three dimensional space away from spectators. In addition, sheaves 301, 302, 303, and 304 provide greater structural stability.

Figure 4:
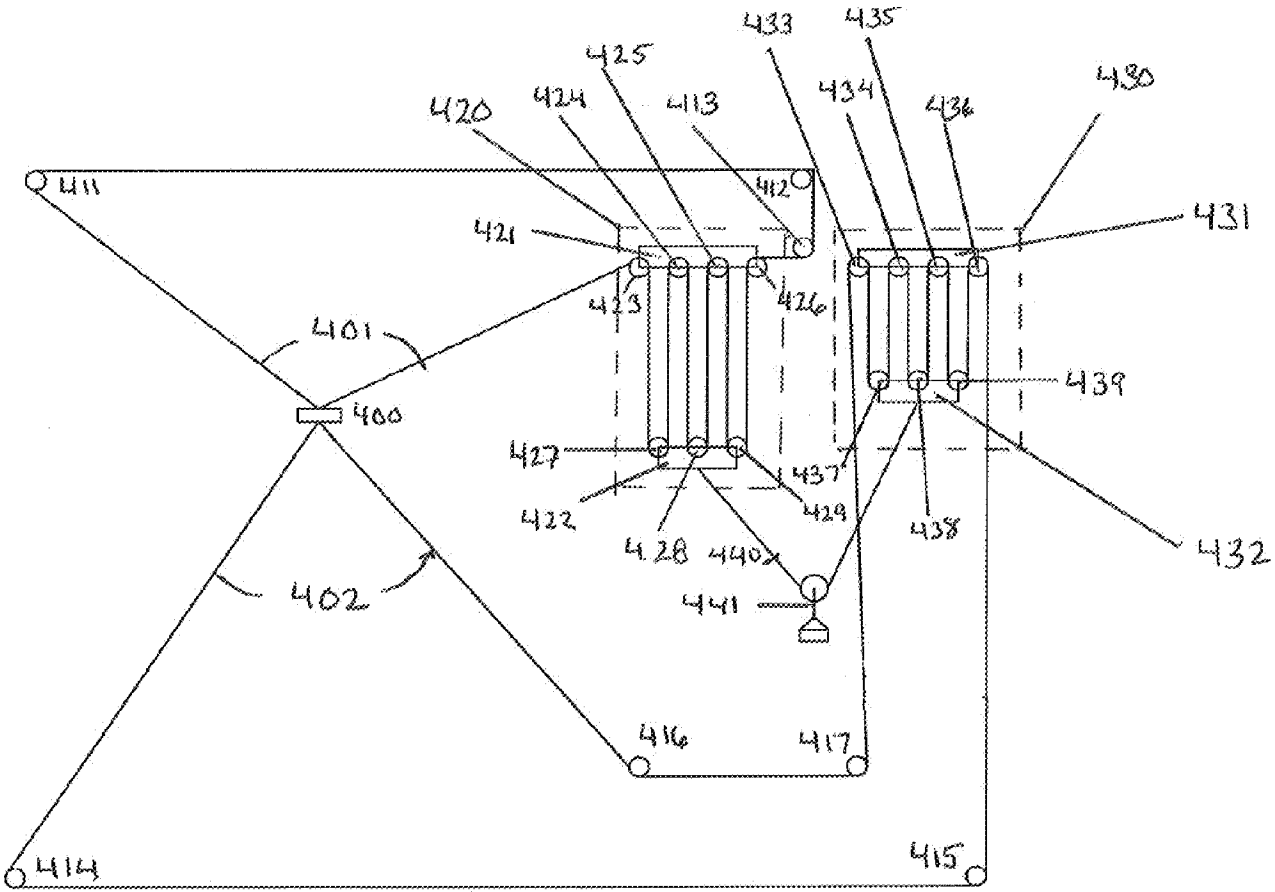
FIG. 4 shows a reeving diagram of a three-dimensional embodiment of the invention.

FIG. 4 presents an embodiment in which two block and tackle devices engage when the camera platform drops below a height threshold due to line breakage of an overlying system for moving an object such as a camera in three dimensions. Examples of such systems include the SKYCAM® and CABLECAM® systems described respectively in U.S. Pat. Nos. 4,710,819 and 6,809,495 the specifications of which are both hereby incorporated herein by reference. In FIG. 4, camera platform 400 is securely attached to lines 401 and 402 either directly as depicted or indirectly through sheaves as show in FIG. 3. The safety of line side 401 is supported by block and tackle 426 and line side 402 is supported by block and tackle 430. From camera platform 400, line 401 reeves through sheaves 411, 412, and 413 and through block and tackle 420 where line 401 then returns to its connection on the camera platform 400. From camera platform 400, line 402 travels through sheaves 414 and 415 to block and tackle 430. Line 402 then travels through sheaves 417 and 416 where line 402 then returns to its connection with camera platform 400. Block and tackle 420 includes a top block 421 and bottom block 422. Top block 421 holds sheaves 423, 424, 425, and 426. Bottom block 422 holds sheaves 427, 428, and 429. Blocks 421 and 422 move towards and away from one another depending on the position of camera platform 400. To prevent the sheaves associated with blocks 421 and 422 from contacting one another when the two opposing blocks move inward into the stop position a stop block made using rubber or other material for absorbing impacts is positioned between said top block 421 and said bottom block 422. The stop block serves to prevent sheaves 423, 424, 425, and 426 associated with top block 421 from touching sheaves 427, 428 and 429 associated with bottom block 422 so as to limit or restrict movement of the sheaves.

Block and tackle 430 includes a top block 431 and bottom block 432. Top block 431 holds sheaves 433, 434, 435, and 436. Bottom block 432 holds sheaves 437, 438, and 439. The bottom block 422 is securely attached to line 440 which travels through a weighted sheave 441 and then travels to the bottom of block 432. Thus the bottom block of both block and tackle 420 and block and tackle 430 are both coupled with weighted sheave 441.

During routine operation, lines 401 and 402 act as passive safety lines that follow camera platform 400 throughout the three dimensional space of the primary aerial cable system which drives movement of camera platform 400. The bulk of the weight of camera platform 400 is held by the aerial cable system tasked with movement of camera platform 400. In the embodiment depicted in FIG. 4 the aerial cable system is able to move the camera platform in three-dimensions meaning along an X-axis, Y-axis and Z-axis. As the camera platform 400 moves, line 401 travels through sheaves 411 and 412, and then through block and tackle 420. Line 402 travels through sheaves 414 and 415, through block and tackle 430, and through sheaves 417 and 416. As the camera platform 400 moves about the three-dimensional space, the amount of line 401 and 402 not stored within block and tackle 420 and 430 respectively will vary. For example, when camera platform 400 moves from the center region to the bottom middle region on FIG. 4, the distance from the camera platform 400 to the block and tackle 420 and from the camera platform 400 to the sheave 414 will increase. This increase in length is accommodated by block and tackle 420 contracting and thereby releasing a greater portion of line 401. Thus as camera platform moves away from block and tackle 420 more line is released when top block 421 and bottom block 422 move inward toward one another.

In the event of cable breakage of the aerial cable system tasked with primary movement of camera platform 400, camera platform 400 begins to fall to the ground. The weight load of camera platform 400 that was previously held primarily by the camera movement system is then transferred to the safety support system. Counterweight 441 then serves to pickup the load previously held by the primary camera movement system and pulls block and tackle system 420 and 430 into a stop position. The stop position is achieved when top blocks 421 and 431 are brought together with bottom blocks 422 and 432. When both block and tackle systems are fully constricted downward movement of camera platform 400 stops thereby leaving camera platform 400 at a safe threshold height. When camera platform 400 is no longer supported by the primary camera movement system block and tackle 420 and block and tackle 430 both constrict by having top blocks 421 and 431 travel in the same direction towards bottom blocks 422 and 432. This serves to limit further downward movement of camera platform 400 and preserves the safety of bystanders. Movement of the line 401 and 402 may also be prevented by placing line breaks in conjunction with sheaves 423, 426, 433 and 438 thereby enabling the system to prevent further line movement during failure of the primary object movement system. In instances where line breaks are used the system is configured to detect a line break and to then initiate the line breaks so as to prevent further movement of camera platform 400.

While the invention herein disclosed has been described by means of specific embodiments and applications thereof, numerous modifications and variations could be made thereto by those skilled in the art without departing from the scope of the invention set forth in the claims.

What is claimed is:

1. A system comprising:

a platform;

a platform movement system coupled to said platform and configured to move said platform;

a safety system configured to prevent said platform from falling below a height threshold, said safety system comprising a line coupled to said platform;

said line woven through a plurality of sheaves into a block and tackle; and, said block and tackle having a counterweight that accepts load from said platform when said platform movement system cannot bear said load as a result of a failure.

2. The system of claim 1 wherein the line is woven through the sheaves resulting in a multiplication factor.

3. The system of claim 2 wherein the multiplication factor is a fourfold multiplication factor.

4. The system of claim 1 further including a braking system.

5. The system of claim 4 wherein the braking system includes a disc brake.

6. The system of claim 1 further comprising a second block and tackle.

7. The system of claim 1 wherein the block and tackle comprises a bottom block and a top block.

8. The system of claim 7 wherein a line connects the bottom block with the counterweight, and the counterweight comprises a floating counterweight.

9. The system of claim 8 wherein a capstan winch is disposed on the line between the bottom block and the floating counterweight.

10. The system of claim 9 wherein the capstan winch includes a disk brake.

11. The system of claim 7 wherein the top block includes four sheaves and the bottom block includes three sheaves.

12. The system of claim 1 wherein the platform movement system is a two dimensional movement system.

13. The system of claim 1 wherein the platform movement system is a three dimensional movement system.

14. The system of claim 1 wherein the safety system is a four point safety system.

15. The system of claim 1 further comprising:

a sensor and a controller.

16. The system of claim 15 further comprising a disk brake and wherein the sensor is capable of detecting the movement of the platform and the controller is capable of locking the disk brake.

17. A system comprising:

a platform;

a platform movement system coupled to said platform and configured to move said platform in three dimensions; and, a safety system configured to prevent said platform from falling below a height threshold, said safety system comprising:

a first line coupled to said platform;

said first line woven through a plurality of first sheaves into a first block and tackle;

a second line coupled to said platform; and, said second line woven through a plurality of second sheaves into a second block and tackle and, said first block and tackle and second block and tackle being coupled to a counterweight that accepts load from said platform when said platform movement system cannot bear said load as a result of a failure.

18. The system of claim 17 wherein the safety system is a four point safety system.

19. The system of claim 17 further comprising:

a sensor, a controller and a disk brake and wherein the sensor is capable of detecting the movement of the platform and the controller is capable of locking the disk brake.

* * * * *